US006745701B2

(12) United States Patent
Elder

(10) Patent No.: US 6,745,701 B2
(45) Date of Patent: Jun. 8, 2004

(54) ANGLED CARGO DISCHARGE GATE

(75) Inventor: John B. Elder, Belleville (CA)

(73) Assignee: EMS-Tech Inc., Belleville (CA)

( * ) Notice: Subject to any disclaimer, the term of this patent is extended or adjusted under 35 U.S.C. 154(b) by 0 days.

(21) Appl. No.: 10/224,325

(22) Filed: Aug. 21, 2002

(65) Prior Publication Data

US 2003/0041771 A1 Mar. 6, 2003

(30) Foreign Application Priority Data

Aug. 24, 2001 (GB) ..... 0120692

(51) Int. Cl.[7] ..... B61D 3/00

(52) U.S. Cl. ..... 105/247; 414/303; 105/250; 298/26

(58) Field of Search ..... 298/26, 27, 31, 298/33, 37; 105/247, 248, 250, 254, 283, 286, 287, 288, 289, 290, 241–242, 239; 414/303, 328, 339, 519, 520; 222/185.1, 415; 49/122

(56) References Cited

U.S. PATENT DOCUMENTS

| | | | | | |
|---|---|---|---|---|---|
| 2,284,781 | A | | 6/1942 | Ward | |
| 3,161,146 | A | * | 12/1964 | Lutts et al. | 105/240 |
| 3,227,100 | A | * | 1/1966 | Smith et al. | 105/286 |
| 3,483,830 | A | * | 12/1969 | McGrath | 105/280 |
| 3,704,797 | A | * | 12/1972 | Suykens | 414/142.3 |
| 3,717,109 | A | * | 2/1973 | Miller | 105/284 |
| 3,902,434 | A | * | 9/1975 | Barnard et al. | 105/240 |
| 4,580,502 | A | * | 4/1986 | Ritzl et al. | 105/240 |
| 4,844,292 | A | * | 7/1989 | Lonardi et al. | 222/503 |
| 5,341,746 | A | * | 8/1994 | Theurer et al. | 105/355 |
| 6,024,023 | A | * | 2/2000 | Magolske | 105/282.1 |

FOREIGN PATENT DOCUMENTS

| | | | | |
|---|---|---|---|---|
| CA | 1 230 780 | | 12/1987 | |
| EP | 184510 | A2 * | 6/1986 | B65D/90/66 |
| EP | 0 104 140 | | 1/1987 | |
| EP | 0 184 510 | | 3/1987 | |
| GB | 1 175 179 | | 12/1969 | |
| GB | 1 196 531 | | 6/1970 | |
| GB | 1 538 183 | | 1/1979 | |
| GB | 1 576 916 | | 10/1980 | |
| GB | 2 081 198 | | 8/1984 | |
| WO | WO 94-04444 | | 3/1994 | |
| WO | WO 99 46187 | | 9/1999 | |

* cited by examiner

*Primary Examiner*—Frantz F. Jules
(74) *Attorney, Agent, or Firm*—Shaprio Cohen; Robert A. Wilkes

(57) ABSTRACT

A basket gate mechanism, including two opposed gate segments supported at its ends by pairs of different length arms interconnected by a mechanism to coordinate the movement of the segments which are opened and closed by a double acting hydraulic cylinder simplifying the opening and closing of the gate; a linkage device to support the gates minimizing torsional stress resulting from the gate being angled, and a pair of shear plates to control the level of the solids discharged onto the conveyor.

20 Claims, 10 Drawing Sheets

ANGLED CARGO DISCHARGE GATE

This invention relates to a bin, hopper or ship's cargo hold discharge gate used in controlling the flow of a particulate material out of the bottom of the bin, hopper, or cargo hold.

The cargo spaces of ships adapted to convey particulate solids in bulk, generally known as bulk carriers, generally comprise a series of cargo holds which are in many ways similar to bulk bins or hoppers used in other applications to contain similar particulate solids. In this context, by "particulate solids" is meant any particulate solid material which is normally conveyed in bulk, in high volume; typical examples are crushed coal, many mineral ores including powdered sulphur, crushed rock, salt, fertilisers, saltpetre and various types of grain. These materials are well adapted to being moved about by continuous feed machinery, typically including the use of continuous belt conveyors, bucket elevators, and the like. These materials also vary in size and bulk density from wheat, which is relatively small and of low bulk density, to minerals which can be about 20 cm or more in diameter and have a relatively high bulk density.

Although a relatively small bin, or hopper, for example as used in a truck or rail car, fitted with a gate mechanism can be emptied from the bottom relatively easily, emptying a relatively large space, such as the sections of a bulk storage facility or the holds of a bulk carrier ship, poses additional problems. In a so-called "self unloading" bulk carrier, the discharge gate system is located in the bottom of each hold, which serves both to close the bottom of the hold, and, when opened, to allow transfer of the hold contents onto a first conveyor means located in a tunnel under the cargo holds. The conveyor moves the received solids along the tunnel, beneath the holds, to an elevator means which is generally at one end of the bulk cargo space, for example in the hull forecastle. The elevator moves the particulate solids essentially vertically, to a point from which they can be discharged from the ship, generally carried by a second conveyor means. In some self unloading bulk carriers each cargo hold can include two or three gate systems, together with the required tunnels and conveyers. Similar underfloor installations are used in bulk storage facilities.

In many self unloading bulk carriers the discharge gate system in each hold comprises a row of centre opening gates, so-called "basket gates", generally located so that the central axis of opening is along the length of the conveyor beneath the gate. The bottom of the hold is tapered downwardly to the row of gates to facilitate solids flow. The length of the gate opening can be from 1 meter to 10 meters, with most gates being in the range of from about 2 meters to 7 meters. The width of the aperture when the gate is open can also be up to 2 meters.

Each basket gate mechanism typically includes two opposed gate segments, and a hydraulic cylinder system to move the segments to open and to close the gate aperture; it is also possible to use linear electrically powered actuators or pneumatic cylinders instead of hydraulic devices. A feature common to all so-called basket gates currently in use is that the gate segments move together and provide equal opening about the centre line of the gate opening; this is usually ensured by linking the segments together by a coordination mechanism. Several coordination mechanisms have been described, including lever systems (see e.g. Ward, U.S. Pat. No. 2,284,781; Leonardi et al., U.S. Pat. No. 4,844,292; Gloucester R.C and W. Co., GB 2 081 198; Elder et al., WO 99/46187; Lorgard, WO 94/04444; and Dominium Magnesium Ltd, GB 1,175,179) hydraulic and pneumatic systems (see e.g. Suykens, U.S. Pat. No. 3,704,797; Hartmann Manuf. Co, GB 1,196,531; and Allis-Chalmers, GB 1,538,183) and gear systems (see e.g. Elder, WO 99/46187). The gate segments have to be substantial structures, as they have to support the load imposed by the cargo when closed, which also means that significant force can be required to move the gate segments.

Although gate openings have increased in length and width, the construction of the basket gate has hardly changed. Each box-like elongate gate segment is mounted between frames which support the top ends of the links carrying the gate segments, the mechanisms used to coordinate gate segment movement, and the hydraulic cylinders used to move them; other than at the ends of a row of basket gates, each frame generally supports the ends of two adjacent gates. The frames and mechanisms between each gate are supported by structures in the bottom of each cargo hold, and are protected by a covering structure, known as a hog back. In the known basket gate, the hydraulic system is arranged to act onto either the coordination mechanism, the ends of the gate segments directly, or at more or less the midpoint of the gate segments, with the result that for each gate at least two, and often four, hydraulic cylinders are required, which both increases first cost and hydraulic installation complexity (especially if a remote control system is used), and requires significant maintenance. Additionally, in the known basket gate systems, the conveyor placed below the gate to receive discharged solids operates at only one preset constant speed. It then follows that the only practical way to control the rate at which particulate solid material is discharged from a selected hold is to control carefully the width of the gate opening, either by separate local manipulation of each gate, or by remote control. In a bulk carrier this requires either an operative to work in an inhospitable and relatively inaccessible space, or a sophisticated control system operating a complex hydraulic system to move the gate segments. Although the control system can usually be located in a reasonably protected space, the hydraulic system is located in the tunnel under the holds, with the consequence that the hydraulic system is located in an aggressive environment and at a location in which maintenance is not easy. Similar problems arise in the construction and operation of gate discharge systems used in sub-floor locations in bulk storage facilities.

A need therefore exists for a simpler, less complex, and more compact basket gate discharge system, which will occupy a smaller space, which provides a measure of discharge rate control, and which does not require a complex hydraulic system. Such a mechanism will have applicability more generally in bulk holding bins, silos, hoppers and rail cars, and more particularly in bulk storage facilities and bulk cargo carriers.

SUMMARY OF THE INVENTION

This invention seeks to provide such a mechanism. In the basket gate according to this invention, the hydraulic system is simplified, and constructed to locate the gate in only three positions: closed, open to an operating position to discharge solids, and fully open to a clean-out position; double acting hydraulic cylinders attached between the gate ends are used to move the gate segments. The movement of the gate segments is preferably coordinated by a gear system, which can be small and compact. Additionally, the longitudinal axis of the gate is located at a small angle relative to the plane defined by the conveyor belt beneath the gate, so that the downstream end of both the gate opening and the hold opening is somewhat wider than the upstream end. In order to compensate for this angle, the mechanisms at each end of the gate which support and coordinate movement of the gate segments provide for differential movement of the gate ends so that torsional twisting of the gate segments is substantially avoided. As a further flow control measure, the downstream ends of each of the gate segments are provided with overlapping shear plates, which define the maximum depth of particulate solid which can be deposited onto the conveyor beneath the gate. The overall space requirements for the basket gate are diminished, since the supporting frames and the hog back needed to protect them are smaller, and the gate structure as a whole is significantly simplified.

In an installation designed and used for only one product, the operating position of the gate segments is chosen to provide a suitable particulate solid flow rate. In order to control the discharge rate for an installation used for several products, the conveyor control system is modified to allow the linear speed of the conveyor to be varied.

Thus in its broadest embodiment this invention seeks to provide an angled discharge gate mechanism, for use in conjunction with a hopper having at least one bottom opening, the bottom opening having an upstream end and a downstream end, through which particulate solid material discharges onto a conveyor located beneath the opening and extending along the longitudinal axis of the opening, the conveyor moving in a downstream direction, the gate mechanism including a pair of gate segments supported at their ends by linkages attached at first ends to a supporting structure and at second ends to the gate segments, which linkages also include gate segment movement coordination means, and a hydraulic system constructed and arranged to move the gate segments to provide a discharge aperture, where the hydraulic system is constructed and arranged to locate the gate segments in a position chosen from the group consisting of fully closed, operating, and clean out the longitudinal axis of the gate is located at an angle of from about 0.5° to about 5° relative to the plane defined by the conveyor, the hopper bottom opening is located at the same angle of from about 0.5° to about 5° relative to the plane defined by the conveyor, the hopper bottom opening is trapezoidal in shape, with its wider end at the downstream end of the gate furthest from the plane defined by the conveyor, the gate discharge aperture provided between the gate segments in either the operating position or the clean out position is trapezoidal in shape, with its wider end furthest from the plane defined by the conveyor and the linkages both supporting the gate segments and coordinating the movement of the gate segments provide differential movement of the gate segment ends without imposing significant torsional stress on the gate segments.

Preferably, the gate also includes two shear plates, each attached to the downstream end of each gate segment and which overlaps with the shear plate at the downstream end of the other gate segment at all three positions for the gate segments, and which control the maximum height of particulate solid material deposited onto the moving conveyor. More preferably, the distance between the bottom edge of the shear plates and the conveyor belt is sufficient to allow the particulate solid deposited onto the conveyor to adopt its normal repose angle. Additionally, the gate also includes sealing plates attached to the upstream ends of each of the gate segments.

Preferably, the conveyor is provided with a variable speed drive means, and a drive means speed controller.

Preferably, in a sequence of discharge gates, the gate longitudinal axes are all inclined at the same angle, and the upstream ends of the gates are all substantially the same distance from the plane defined by the conveyor.

Preferably, the width of the gate opening provided when the gate segments are moved to the operating position is at least 1.5 times the average particle size of a particulate solid material contained in the hopper.

Preferably, the gate supporting linkages, coordinating means and supporting structures having a first frame means adjacent a first end of the gate aperture and a second frame means adjacent a second end of the gate aperture. A pair of first linkage means including pairs of linkage arms, the arms in each pair being rotatably attached at one end to the first frame means, and at the other end to spaced apart locations at each first end of the gate segments, and a pair of second linkage means including pairs of linkage arms, the arms in each pair being rotatably attached at one end to the second frame means, and at the other end to spaced apart locations at each second end of the gate segments are also included. Furthermore, the gate supporting linkages, the coordinating means and the supporting structures include a first gear means attached to the first linkage means in cooperating relationship between each pair of first linkage means, a second gear means attached to the second linkage means in cooperating relationship between each pair of second linkage means, a first gate segment actuating means connected between each first end of the gate segments, and a second gate segment actuating means connected between each second end of the gate segments. The direction of travel of the conveyor is from the first ends of the gate segments toward the second ends of the gate segments and the linkage arms in the first linkage means are each shorter than the linkage arms at the same positions in the second linkage means by an amount sufficient to minimise any torsional stress placed on the gate segments when the gate is moved between its closed, operating, and clean out positions.

Preferably, the gear means is located between one arm of a pair of arms attached to first gate segment, and the adjacent arm of a second pair of arms attached to the second gate segment. More preferably, the gear means comprises a first gear segment incorporated in one arm of a pair of arms attached to first gate segment; a first rotatable gear meshed with the first segment; a second rotatable gear meshed with the first gear; and a second gear segment attached to the adjacent arm of a second pair of arms meshed with the second gear.

Preferably, within each pair of arms, the arms are of differing length so that the gate segments slope downwardly toward the conveyor when the gate is opened.

Alternatively, the gate supporting linkages, coordinating means and supporting structures having first frame means adjacent a first end of the gate aperture and a second frame means adjacent a second end of the gate aperture. A first pair of support plate means including a first member each being attached at one end to each first end of the gate segments and rotatably at the other end to spaced part locations on the first frame means and a second pair of support plate means including a second member each being attached at one end to each second end of the gate segments and rotatably at the other end to spaced part locations on the second frame mean are also included. Furthermore, the gate supporting linkages, the coordinating means and the supporting structures include at least one gate segment movement coordinating means comprising a first link, a second link and a third joining link, each of which links has a first end and a second end and a support shaft. The first end of the first link is rotatably attached to the first member of the first pair of support plate means, the second end of the first link is rotatably attached to the first end of the third joining link, the second end of the third joining link is rotatably to the first end of the second link, the second end of the second link is rotatably attached to a second member of the second pair of support plate means, the first and second links are of substantially the same length and the third joining link is slidably attached to the shaft by a sliding engagement means constructed and arranged to maintain the third joining linkage substantially perpendicular to the shaft.

Preferably, the first and second links are the same length, and are longer than the third link. More preferably, the first and second links are the same length, and are both about twice as long as the third joining link.

Preferably, the shaft is round and the sliding engagement means comprises a tubular sleeve.

For clarity, a portion of the particulate solids in the hopper is shown only in FIG. 1; as is explained in more detail below, in FIGS. 8, 9 and 10 the hopper is largely empty of particulate solid material.

Figure 1:
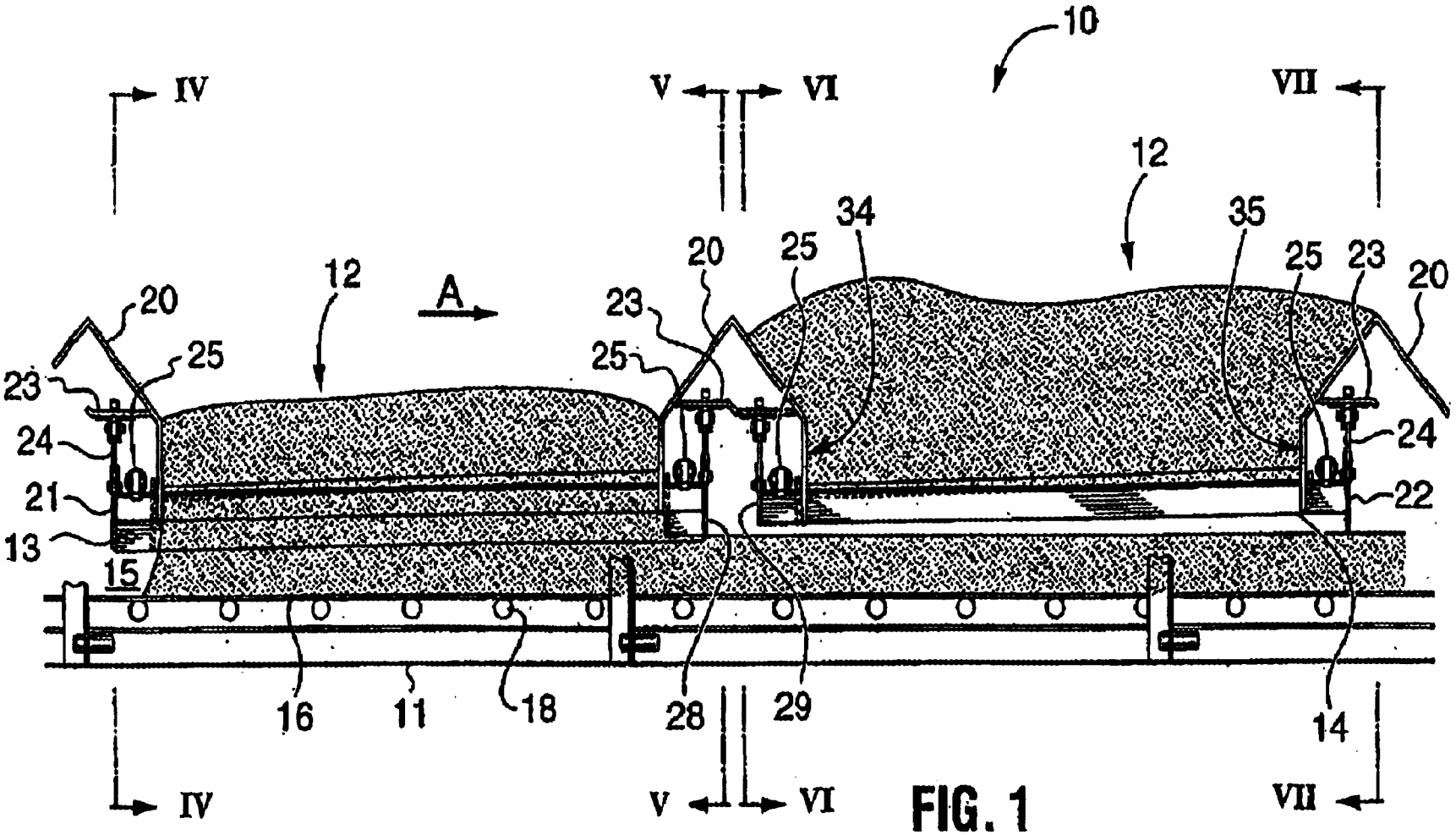
FIG. 1 shows a partly sectioned side elevation of a part of the hold of a bulk carrier including two angled gates, one closed and the other opened to the operating position.

Referring first to FIG. 1, the lower part of a typical bulk carrier cargo space 10 is shown. The cargo space is contained within a hull 11 which is divided into cargo holds 12, of which a section including two gates 13 and 14 is shown. The number of gates used in each hold depends on the overall size of the ship. In the tunnel 15 below the holds is located a conveyor 16, which transports the particulate material carried as a bulk cargo along the length of the holds. The conveyor 16 is supported by sets of rollers 17, 18, 19 which give the conveyor a trough-like shape (see also FIG. 5). The holds of such a bulk carrier may include one tunnel 15 and conveyor 16, or more than one. The sequence of basket gates 13, 14 is located above the conveyor, with their longitudinal axes more or less above the centre line of the conveyor 16. The gate operating mechanisms are protected by hog backs 20. As shown, the conveyor moves in the direction of the arrow A, from the upstream end 21 of gate 13 toward and past the downstream end 22 of gate 14.

The two gates 13, 14 are similarly constructed. Inside each hog back 20 a frame 23 supports the top ends of the linkages shown generally at 24; the bottom ends of these linkages are attached to the gate segments. The linkages are described in more detail below with reference to FIGS. 4 and 5. The gate is opened and closed by paired hydraulic cylinders 25. These pairs of double acting cylinders are set up so that the gate segments can be located in only three positions:

with both cylinders retracted, the gate is closed;

with one cylinder extended, the gate is open to the operating position; and with both cylinders extended, the gate is open to the clean out position.

Double acting paired cylinders of this general type are well known. The cylinders are mounted between cooperating lugs 26, 27 which are attached to the ends of the gate segments (see FIG. 12).

The gates are not located with the bottom opening parallel to the plane defined by the conveyor 16. Taking gate 13 as exemplary, its upstream end 21 is closer to the plane of the conveyor than its downstream end 28; similarly for gate 14 the upstream end 29 is closer to the conveyor than the downstream end 24. The frames 23 are constructed to provide this angle. The angle between the gate and the conveyor is not large. The angle will generally be in the range of from about 0.5° to about 5°, and for most applications will be from about 2° to about 4°.

As shown in FIG. 1, both of gates 13, 14 are at the same angle to the conveyor 16; this is the preferred arrangement for a sequence of gates.

Figure 2:
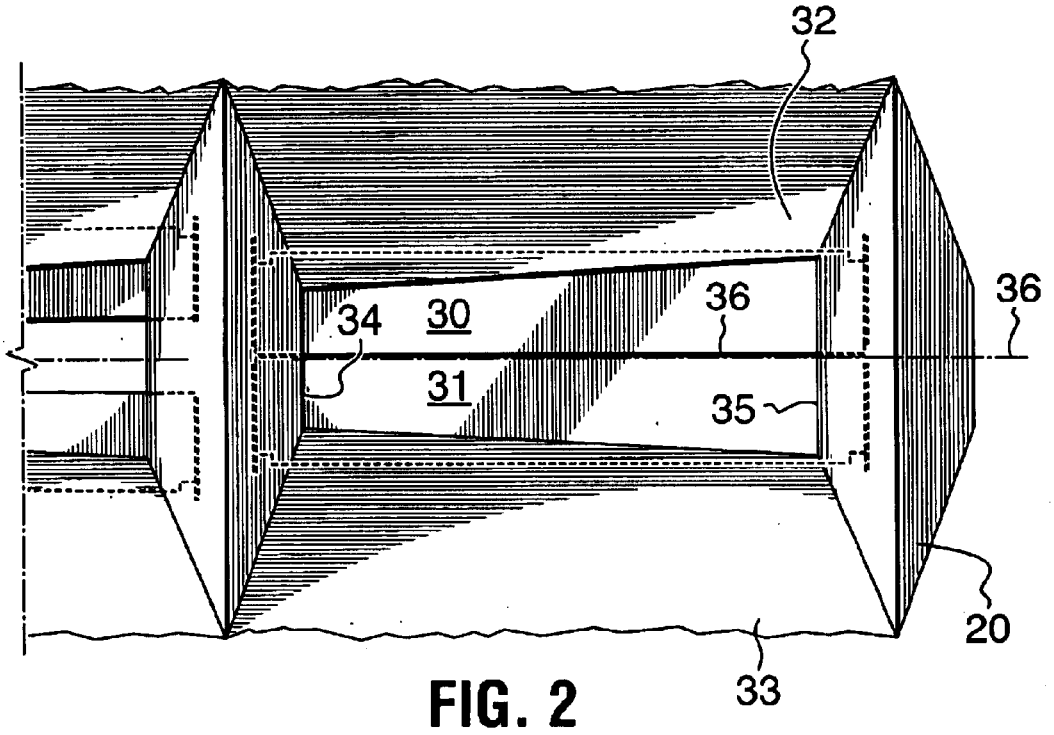
FIG. 2 shows a plan view of the closed gate in FIG. 1.
Figure 3:
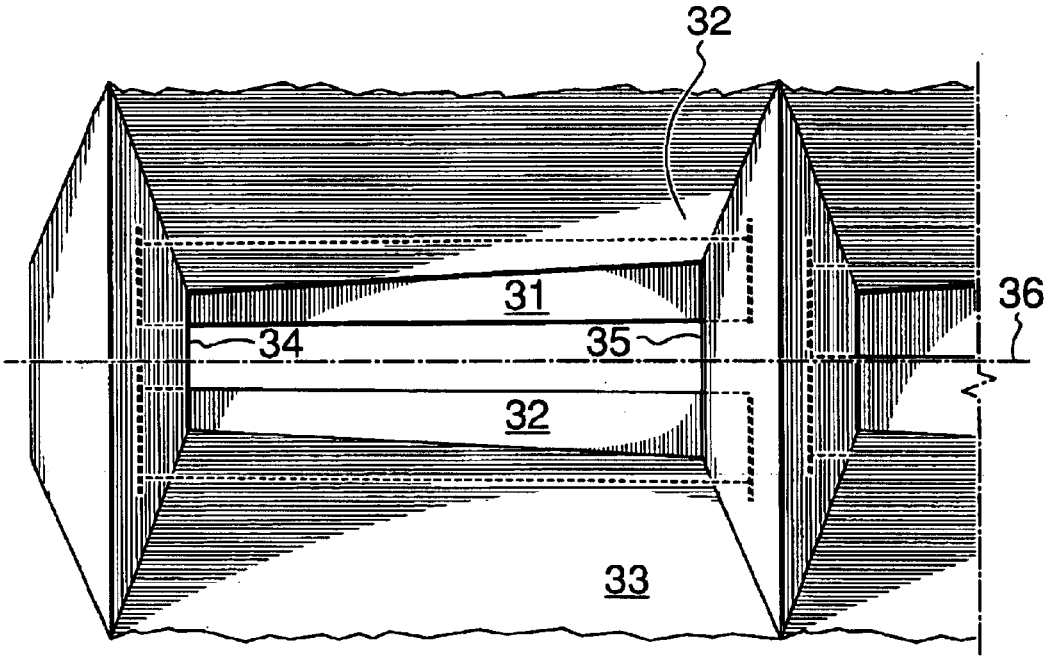
FIG. 3 shows a plan view of the opened gate in FIG. 1.

Some of the consequences of the gate angle are shown in FIGS. 2 and 3.

FIG. 2 shows in plan gate 14 in the closed position. The two gate segments 30, 31 close the opening between the hopper discharge plates 32 and 33, and the end plates 34, 35, each of which from part of a hog back 20 (see also FIG. 1). Although the two gate segments meet on the longitudinal axis 36, the hopper discharge opening defined by the edges of the plates 32, 33, 34 and 35 is trapezoidal in shape, as well as being angled relative to the conveyor 16. This shape is located with its wider end at plate 35 at the downstream end of the opening.

FIG. 3 shows in plan gate 14 in the operating position. The opening thus provided between the two gate segments 30 and 31 within the overall hopper opening defined by the plates 32, 33, 34 and 35 is also trapezoidal, and also has its wider end at the downstream end of the gate.

Figure 4:
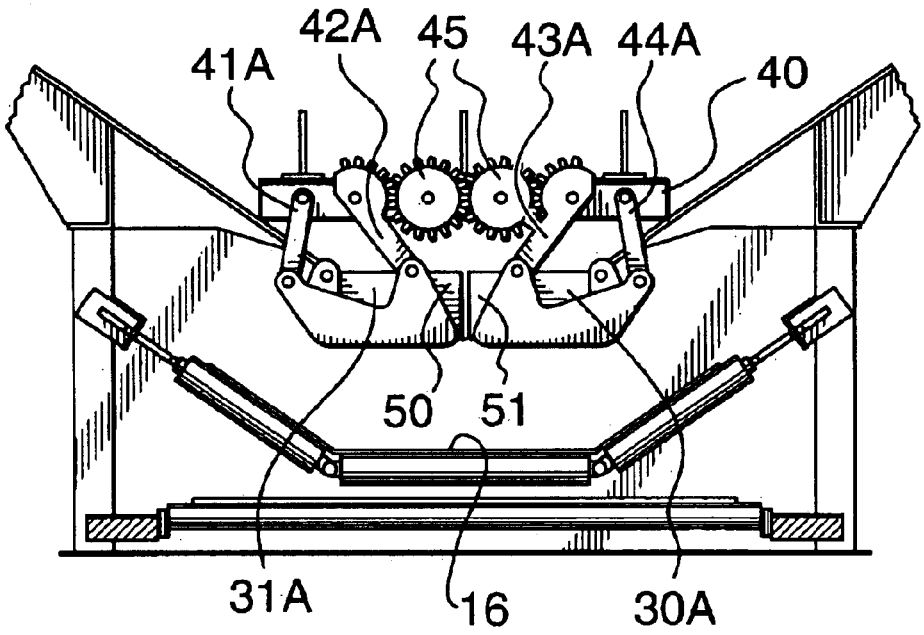
FIGS. 4 and 5 show partly sectioned views on lines IV and V respectively of the closed gate in FIG. 1.
Figure 5:
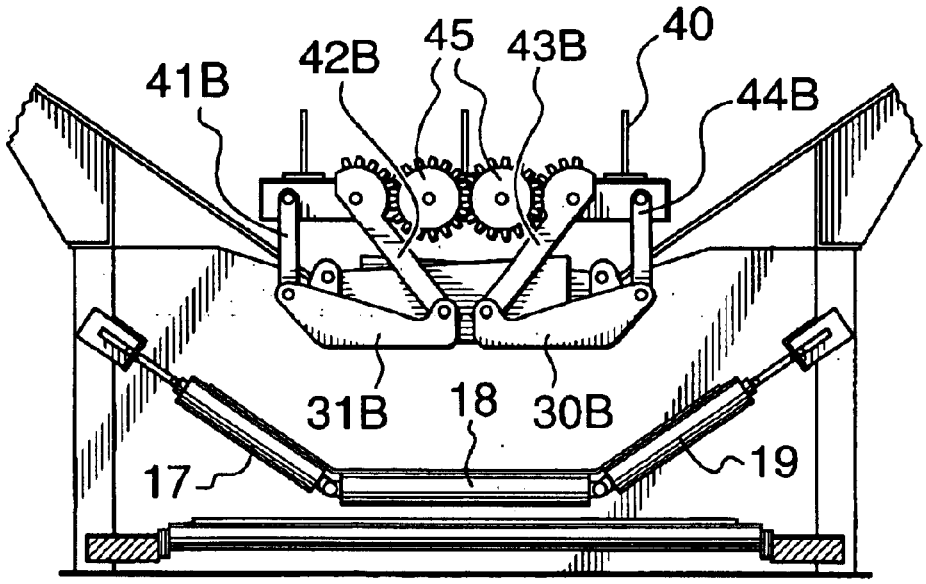

In FIGS. 4 and 5 a modified typical known basket gate mechanism is shown in the closed position; for clarity much of the supporting steel framing 23 and the hog back 20 is omitted. The basket gate is supported by the framing shown generally at 40. Each gate segment 30, 31—shown closed in FIGS. 4 and 5—is supported at each end by two pairs of unequal length arms. The pairs of arms 41A, 42A, and 43A, 44A are each attached to the upstream ends 30A and 31A of the gate segments (FIG. 4), and the pairs of arms 41B, 42B, and 43B, 44B are each attached to the downstream ends 30B and 31B of the gate segments (FIG. 5). Within each pair of arms the outer arms are shorter than the inner arms, so that when closed the gate segments are more or less horizontal, and when open are angled downwardly so as not to obstruct solids flow, and to direct the solids flow onto the conveyor 16. The inner arms 42A, 43A, 42B and 43B include integral gear segments which are meshed together by the gears 45, thus insuring that the gate segments move together.

Figure 6:
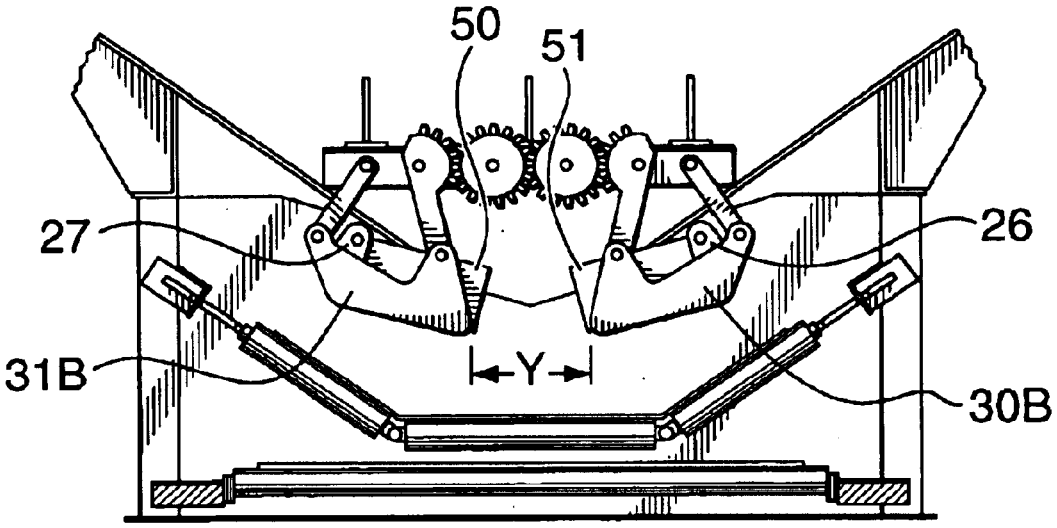
FIGS. 6 and 7 show partly sectioned views on lines VI and VII respectively of the open gate in FIG. 1.
Figure 7:
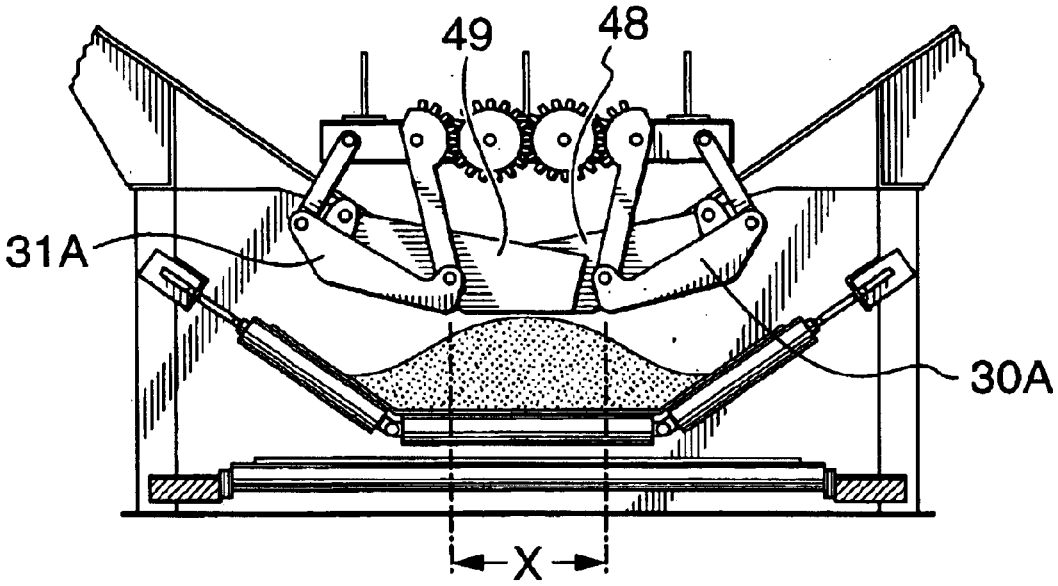

Comparison of FIGS. 4 and 5 also shows that in addition to the length differences within each pair of arms, the arms in the A set are also of a different length to the corresponding arms in the B set. Due to this difference, although the hydraulic cylinders all move the same distance, the upstream and downstream ends of the gate segments move through different distances, thus providing the trapezoidal shaped operating opening shown in FIG. 3. This difference can be seen more clearly by comparing FIGS. 6 and 7 which show the same gate in the operating position. The gap at X between the downstream ends 30A and 31A is wider than the gap at Y between upstream ends 30B and 31B.

Figure 9:
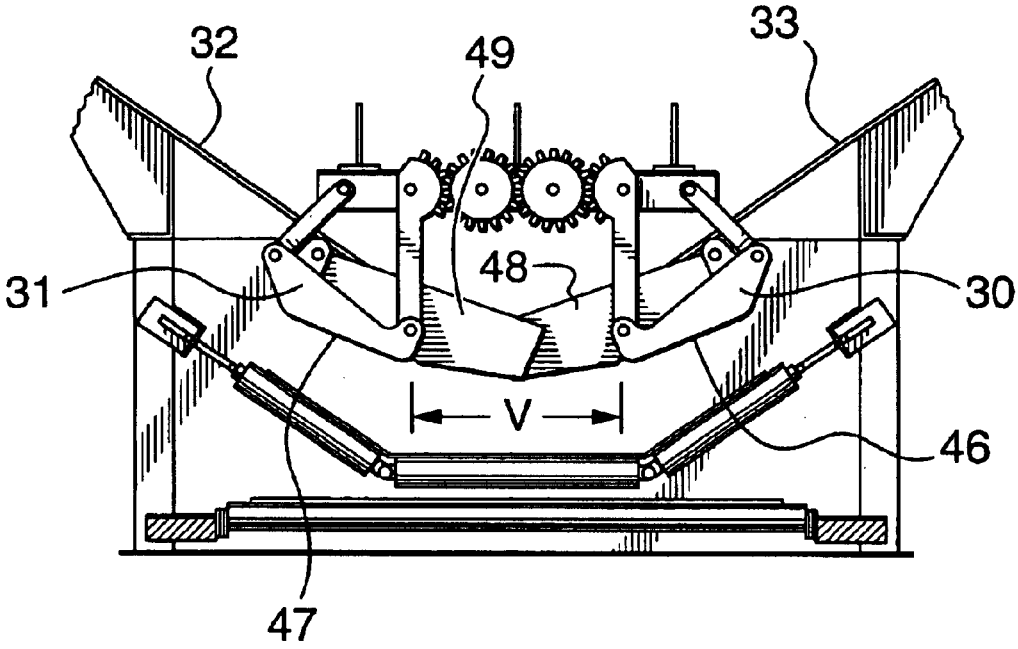
FIGS. 9 and 10 show partly sectioned views corresponding to FIGS. 6 and 7 with the gate moved to the clean out position.
Figure 10:
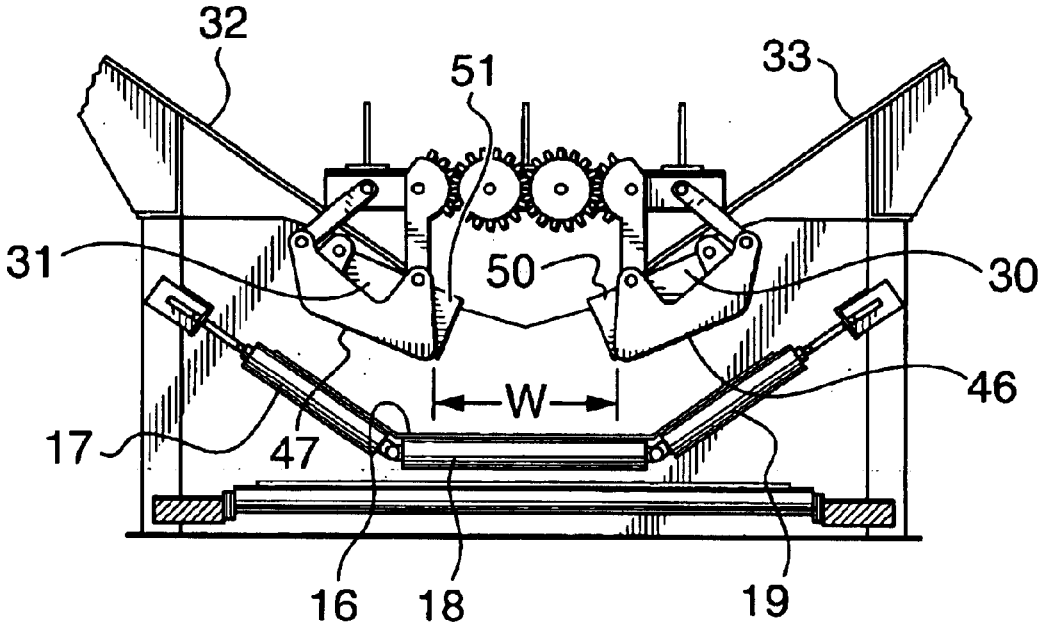

Similarly, when the gate is opened to the clean out position the gap is wider at the downstream end: the distance V in FIG. 9 is greater than the distance W in FIG. 10.

Figure 8:
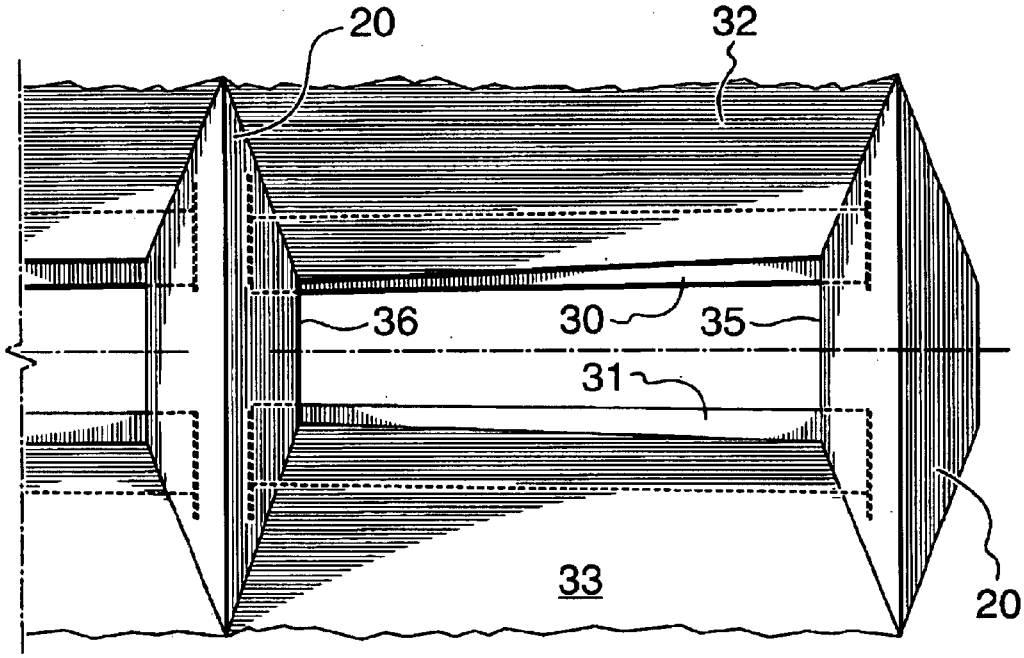
FIG. 8 shows a plan view of the gate of FIG. 1 opened to the clean out position.

In FIGS. 8, 9 and 10 the same gate is shown in the clean out position; FIG. 8 is a plan view, and FIGS. 9 and 10 correspond to FIGS. 4 and 5 respectively. In this position, the two gate segments 30, 31 are fully retracted to provide an opening of substantially the same size as the hopper discharge opening. As can be seen in FIGS. 9 and 10, due to the different arms lengths used at each end of the gate segments, the segments are now angled so that the gate surfaces 46, 47 are downwardly angled to be more or less parallel with the slope of the hopper plates 32 and 33. This gate position is used when the hopper is more or less empty, to ensure discharge of any remaining material.

FIGS. 9 and 10 also show two further features of the angled discharge gate of this invention.

In FIG. 9 (and also in FIGS. 5 and 7), two shear plates 48 and 49 can be seen, at the downstream ends of gate segments 30 and 31 respectively. Inspection of FIGS. 5, 7 and 10, which all show the same end of a gate, shows that at all positions of the gate the ends of the shear plates overlap. As can be seen in FIG. 1, the shear plates serve to control the overall height of particulate solid deposited onto the conveyor 16. Due to the abrasive wear of the shear plates by the particulate solids, these should be provided with a hardened bottom edge, or preferably with a nose plate including ceramic wear surfaces fabricated from a wear resistant material such as a ceramic, titanium carbide or the like.

In FIG. 10 (and also in FIGS. 4 and 6), two control plates 50 and 51 can be seen, at the upstream ends of gate segments 30 and 31 respectively. These plates serve to ensure that the upstream end of the gate is sealed when the gate is closed (FIG. 4), and to limit to some degree the quantity of particulate solid that can spill in the upstream direction when the gate is in the operating position (see also FIG. 1).

Figure 11:
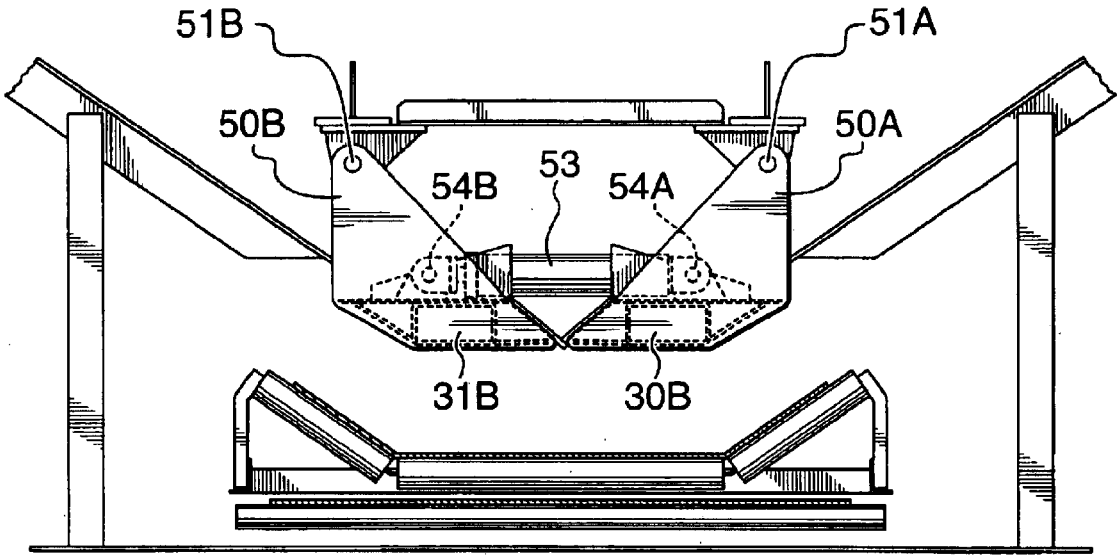
FIGS. 11, 12, 13, 14, 15 and 16 show an alternative gate suspension mechanism in each of the closed, operating and clean out positions.
Figure 12:
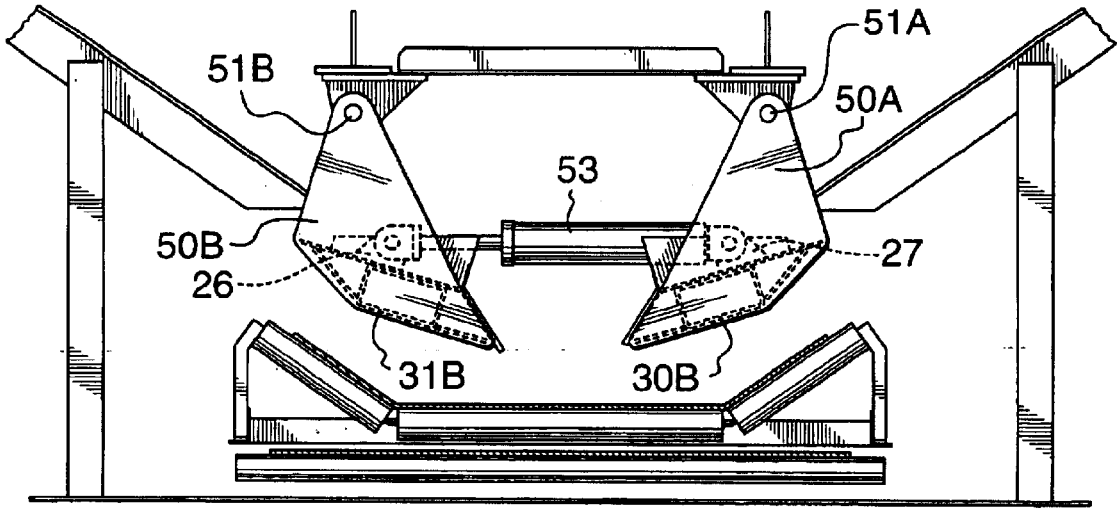
Figure 13:
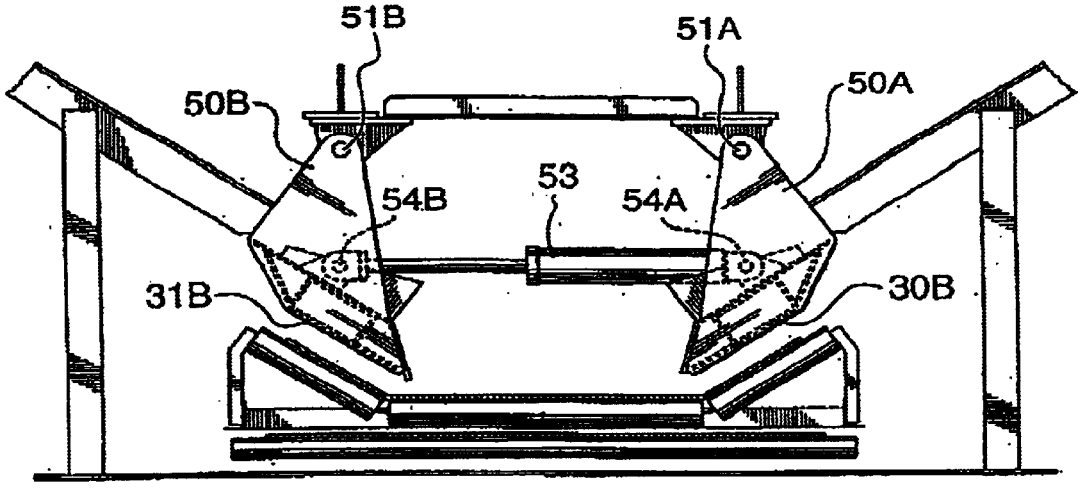
Figure 14:
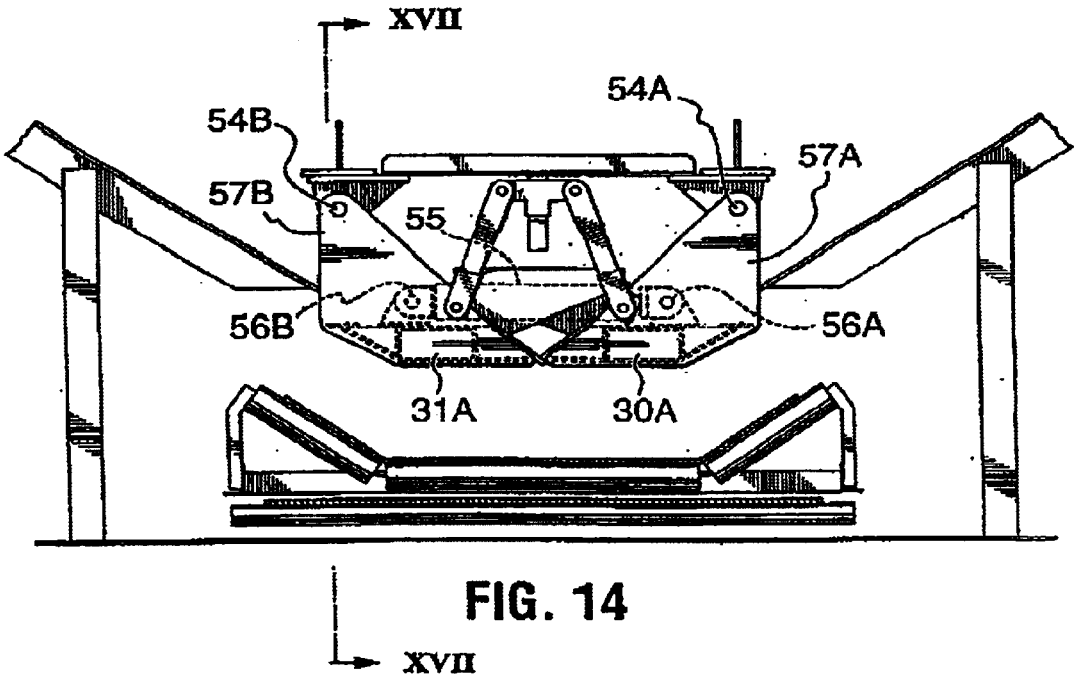
Figure 15:
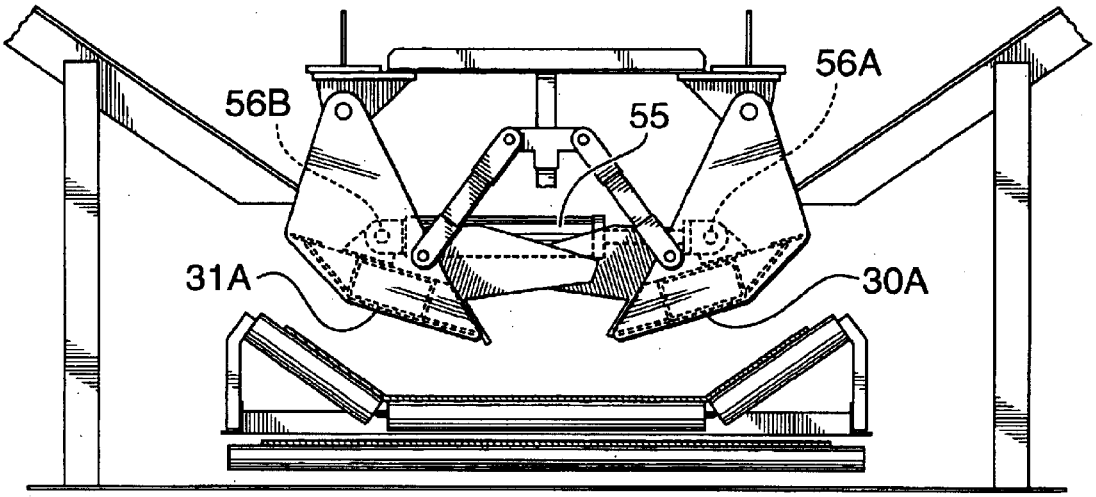
Figure 16:
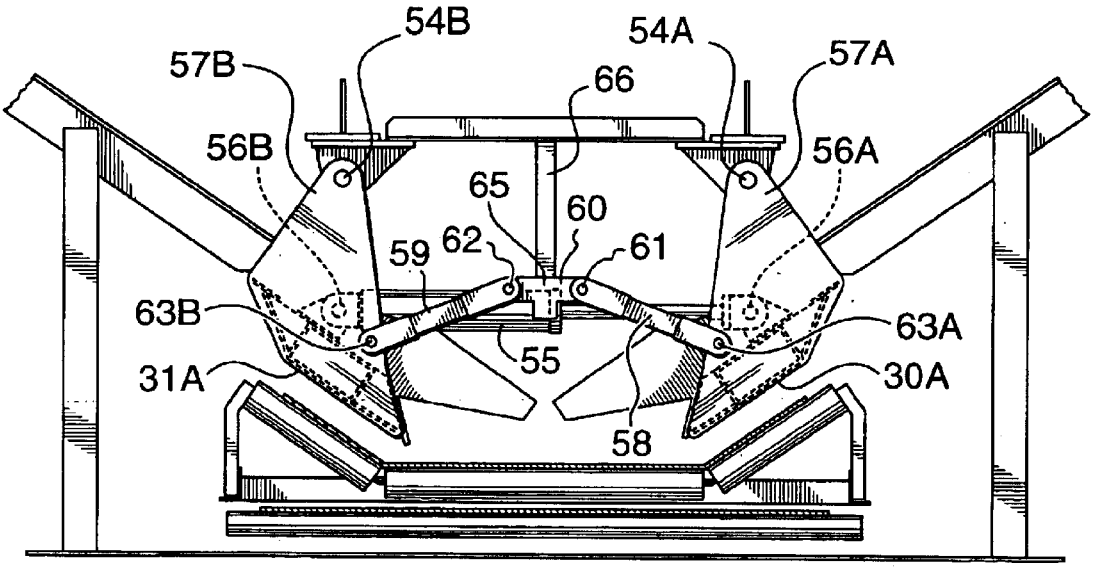
Figure 17:
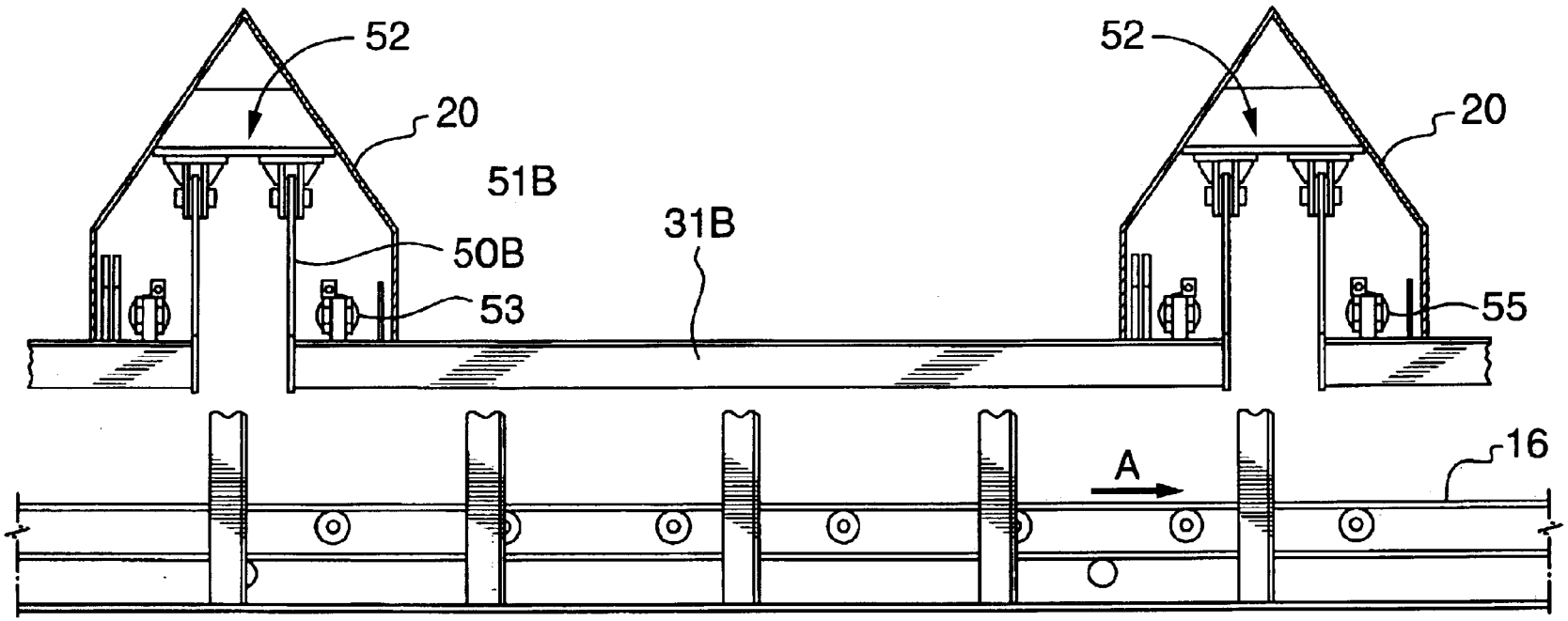
FIG. 17 shows a cross section of FIG. 14 on line XVII.

In FIGS. 11–17 a simpler gate suspension system is shown in each of the closed, operating and clean out positions. In FIGS. 11–16, the construction of the basket gate is the same as is shown in FIGS. 1–10 and will not be discussed further. FIGS. 11, 12 and 13 show the mechanism used at the non-shearing end of the basket gate and correlate with the mechanisms at the upstream end 21 of the gate 13 shown in FIG. 1. FIGS. 14, 15 and 16 show the mechanism at the downstream end of the gate 13 and correlate with the mechanism shown at the downstream end 24 of the gate shown in FIG. 1.

Referring first to FIGS. 11, 12 and 13 the non-shearing end of the gate is shown in the closed position, the operating position and the clean out position in FIGS. 11, 12 and 13 respectively. At their upstream, non-shearing, ends 30B and 31B the two basket gate segments are each provided with a suspension plate 50A, 50B (see also FIG. 17). The suspension plates 50A, 50B are each journalled onto pins 51A and 51B which, in their turn, are supported by suitable framing within the hog back, as at 52 in FIG. 17. This suspension allows the upstream ends 30B and 31B of the gate segments to rotate though and arc as the gate is moved from the closed position (FIG. 11) to the operating position (FIG. 12) and thence to the clean out position (FIG. 13). Movement of the gate segments between these three positions is controlled by a double acting hydraulic cylinder 53 which is connected to the gate segments by suitable pins as at 54A and 54B. The cylinder is also set up so that it can only locates the basket gate segments in one of the three required positions.

A different mechanism is used at the shearing end of the basket gate, which is shown in FIGS. 14, 15 and 16 in the closed, operating and clean out positions respectively. The two ends 30A and 31A again carry support plates 57A, 57B which are journalled onto pins 54A and 45B: this construction is the same as that at the other end of the gate. Similarly, movement of the gate segments is controlled by double acting hydraulic cylinders 55 attached to the gate segments as at 56A and 56B; a similar arrangement is provided at the other end of the basket gate.

In order to coordinate the movement of the two halves of the basket gate a coordinating linkage is provided between the gate segments. As shown, this is located at the shearing end of the gate, and is shown in FIG. 16; if desired two coordinating linkages can be provided, one at each end of the gate segments. The linkage comprises a first link 58, second link 59 and third joining link 60; one end of each of the first and second links 58, 59 is rotatably attached to an end of the third joining link 60 by suitable pin joints as at 61 and 62. The first and third links 58, 59 are also rotatably attached to the support plates 57A, 57B, again by suitable pin joints as at 63A, 63B. In order to minimise torsional stress on the gate segments the first and second links are substantially the same length, and are longer than the third link: as shown, the first and second links are about twice as long as the third link. The third link 60 is constructed so that at its mid-point 65 it is attached by a slidable engagement means onto the shaft 66 so that it can move in a more or less vertical direction on shaft 66. The sliding engagement means also maintains the third link in a more or less horizontal position so that the third joining linkage is substantially perpendicular to the shaft 66. Several suitable mechanisms are known for this purpose. In a typical construction the shaft 66 is round and the link 60 is provided with a suitable length tubular sleeve; a pin and slot arrangement could also be used.

In the preceding description, the hold of a bulk carrier cargo ship is taken as the example. The angled bulk discharge gate of this invention is also applicable in other installations, such as bulk cargo transhipment or storage facilities, hopper cars, and silos in which a bulk particulate material is retrieved from a bulk storage space.

What is claimed is:

1. An angled discharge gate mechanism for use in conjunction with a hopper having at least one bottom opening, the bottom opening having an upstream end and a downstream end, through which particulate solid material discharges onto a conveyor located beneath the opening and extending along the longitudinal axis of the opening, the conveyor moving in a downstream direction, the gate mechanism including a pair of gate segments supported at their ends by linkages attached at first ends to a supporting structure and at second ends to the gate segments, which linkages also include gate segment movement coordination means, and a hydraulic system constructed and arranged to move the gate segments to provide a discharge aperture, wherein:

(a) the hydraulic system is constructed and arranged to locate the gate segments in a position chosen from the group consisting of fully closed, operating, and clean out;

(b) the longitudinal axis of the gate, is located at an angle of from about 0.5° to about 5° relative to the plane defined by the conveyor;

c) the hopper bottom opening is located at the same angle of from about 0.5° to about 5° relative to the plane defined by the conveyor;

(d) the hopper bottom opening is trapezoidal in shape, with its wider end at the downstream end of the gate furthest from the plane defined by the conveyor;

e) the gate discharge aperture provided between the gate segments in either the operating position or the clean out position is trapezoidal in shape, with its wider end furthest from the plane defined by the conveyor; and (f) the linkages both supporting the gate segments and coordinating the movement of the gate segments provide differential movement of the gate segment ends without imposing significant torsional stress on the gate segments.

2. An angled discharge gate mechanism according to claim 1 further including two shear plates, each attached to the downstream end of each gate segment and which overlaps with the shear plate at the downstream end of the other gate segment at all three positions for the gate segments, and which control the maximum height of particulate solid material deposited onto the moving conveyor.

3. An angled discharge gate mechanism according to claim 2 wherein the distance between the bottom edge of the shear plates and the conveyor belt is sufficient to allow the particulate solid deposited onto the conveyor to adopt its normal repose angle.

4. An angled discharge gate mechanism according to Claim 2 further including sealing plates attached to the upstream ends of each of the gate segments.

5. An angled discharge gate mechanism according to Claim 1 further including a conveyor variable speed drive means, and a drive means speed controller.

6. An angled discharge gate mechanism according to claim 1 wherein, in a sequence of discharge gates, the gate longitudinal axes are all inclined at the same angle, and the upstream ends of the gates are all substantially the same distance from the plane defined by the conveyor.

7. An angled discharge gate mechanism according to claim 1 wherein the width of the gate opening provided when the gate segments are moved to the operating position is at least 1.5 times the average particle size of a particulate Solid material contained in the hopper.

8. An angled discharge gate mechanism according to claim 1 wherein the gate supporting linkages and supporting structures comprise in combination:

a first frame means adjacent a first end of the gate aperture;

a second frame means adjacent a second end of the gate aperture;

a pair of first linkage means including pairs of linkage arms, the arms in each pair being rotatably attached at one end to the first frame means, and at the other end to spaced apart locations at each first end of the gate segments;

a pair of second linkage means including pairs of linkage arms, the arms in each pair being rotatably attached at one end to the second frame means, and at the other end to spaced apart locations at each second end of the gate segments;

a first gear means attached to the first linkage means in cooperating relationship between each pair of first linkage means;

a second gear means attached to the second linkage means in cooperating relationship between each pair of second linkage means;

a first gate segment actuating means connected between each first end of the gate segments; and a second gate segment actuating means connected between each second end of the gate segments;

wherein:

(i) the direction of travel of the conveyor is from the first ends of the gate segments toward the second ends of the gate segments; and (ii) the linkage arms in the first linkage means are each shorter than the linkage arms at the same positions in the second linkage means by an amount sufficient to minimise any torsional stress placed on the gate segments when the gate is moved between its closed, open, and clean out positions.

9. An angled discharge gate mechanism according to claim 8 wherein the gear means is located between one of the arms of the pair of arms attached to first gate segment, and the adjacent arm of a second pair of arms attached to the second gate segment.

10. An angled discharge gate mechanism according to claim 8 wherein the gear means comprises a first gear segment incorporated in one of the arms of the pair of arms attached to first gate segment; a first rotatable gear meshed with the first segment; a second rotatable gear meshed with the first gear; and a second gear segment attached to the adjacent arm of the second pair of arms meshed with the second gear.

11. An angled discharge gate mechanism according to claim 8 wherein within each pair of arms, the arms are of differing length so that the gate segments slope downwardly toward the conveyor when the gate is opened.

12. An angled discharge gate mechanism according to claim 1 wherein the hydraulic system comprises a pair of double acting cylinders constructed and arranged so that operation of a first cylinder of the pair of cylinders moves the gate segments between the fully closed and operating positions, and operation of a second cylinder of the pair of cylinders moves the gate segments between the operating and clean out positions.

13. An angled discharge gate mechanism according to claim 1 wherein the gate supporting linkages, coordinating means and supporting structures comprise in combination:

a first frame means adjacent a first end of the gate aperture;

a second frame means adjacent a second end of the gate aperture;

a first pair of support plate means including a first member each being attached at one end to each first end of the gate segments and rotatably at the other end to spaced part locations on the first frame means;

a second pair of support plate means including a second member each being attached at one end to each second end of the gate segments and rotatably at the other end to spaced part locations on the second frame means;

at least one gate segment movement coordinating means comprising a first link, a second link and a third joining link, each of which links has a first end and a second end; and a support shaft;

wherein:

(i) the first end of the first link is rotatably attached to the first member of the first pair of support plate means;

(ii) the second end of the first link is rotatably attached to the first end of the third joining link;

(iii) the second end of the third joining link is rotatably to the first end of the second link;

(iv) the second end of the second link is rotatably attached to the second member of the second pair of support plate means;

(v) the first and second links are of substantially the same length; and (vi) the third joining link is slidably attached to the shaft by a sliding engagement means constructed and arranged to maintain the third joining linkage substantially perpendicular to the shaft.

14. An angled discharge gate mechanism according to claim 13 wherein the first and second links are the same length, and are longer than the third link.

15. An angled discharge gate mechanism according to claim 13 wherein the first and second links are the same length, and are both about twice as long as the third joining link.

16. An angled discharge gate mechanism according to claim 13 wherein the shaft is round and the sliding engagement means comprises a tubular sleeve.

17. An discharge gate mechanism for use in conjunction with a hopper having at least one bottom opening, the bottom opening having an upstream end and a downstream end, through which particulate solid material discharges onto a conveyor located beneath the opening and extending along the longitudinal axis of the opening, the conveyor moving in a downstream direction, the gate mechanism including a pair of gate segments supported at their ends by linkages attached at first ends to a supporting structure and at second ends to the gate segments, which linkages also include gate segment movement coordination means, and a hydraulic system constructed and arranged to move the gate segments to provide a discharge aperture, wherein the gate supporting linkages, coordinating means and supporting structures comprise in combination:

a first frame means adjacent a first end of the gate aperture;

a second frame means adjacent a second end of the gate aperture;

a first pair of support plate means including a first member each being attached at one end to each first end of the gate segments and rotatably at the other end to spaced part locations on the first frame means;

a second pair of support plate means including a second member each being attached at one end to each second end of the gate segments and rotatably at the other end to spaced part locations on the second frame means;

at least one gate segment movement coordinating means comprising a first link, a second link and a third joining link, each of which links has a first end and a second end; and a support shaft;

wherein:

(i) the first end of the first link is rotatably attached to the first member of the first pair of support plate means;

(ii) the second end of the first link is rotatably attached to the first end of the third joining link;

(iii) the second end of the third joining link is rotatably to the first end of the second link;

(iv) the second end of the second link is rotatably attached to the second member of the second pair of support plate means;

(v) the first and second links are of substantially the same length; and (vi) the third joining link is audibly attached to the shaft by a sliding engagement means constructed and arranged to maintain the third joining linkage substantially perpendicular to the shaft.

18. An angled discharge gate mechanism according to claim 17 wherein the first and second links are the same length, and are longer than the third link.

19. An angled discharge gate mechanism according to claim 17 wherein the first and second links are the same length, and are both about twice as long as the third joining link.

20. An angled discharge gate mechanism according to claim 17 wherein the shaft is round and the sliding engagement means comprises a tubular sleeve.

* * * * *